US006113353A

United States Patent [19]

Sato et al.

[11] Patent Number: 6,113,353

[45] Date of Patent: Sep. 5, 2000

[54] AXIAL FAN

[75] Inventors: Seiji Sato; Tadashi Ohnishi; Zhiming Zheng, all of Sakai, Japan

[73] Assignee: Daikin Industries, Ltd., Osaka, Japan

[21] Appl. No.: 09/101,340

[22] PCT Filed: Nov. 7, 1997

[86] PCT No.: PCT/JP97/04058

§ 371 Date: Jul. 8, 1998

§ 102(e) Date: Jul. 8, 1998

[87] PCT Pub. No.: WO98/21482

PCT Pub. Date: May 22, 1998

[30] Foreign Application Priority Data

Nov. 12, 1996 [JP] Japan ..... 8-300181

[51] Int. Cl.[7] ..... F04D 29/38

[52] U.S. Cl. ..... 416/232; 416/223 R; 416/228; 416/237; 416/242; 416/243; 415/119

[58] Field of Search ..... 416/223 R, 232, 416/235, 237, 236 R, 228, 243, DIG. 2, DIG. 5, 242; 415/119

[56] References Cited

U.S. PATENT DOCUMENTS

| | | | |
|---|---|---|---|
| 1,622,222 | 3/1927 | Caldwell | 416/DIG. 2 |
| 2,772,855 | 12/1956 | Stalker | 416/232 |
| 4,664,593 | 5/1987 | Hayashi et al. | 415/119 |
| 5,215,441 | 6/1993 | Evans et al. | 416/228 |

FOREIGN PATENT DOCUMENTS

| | | | |
|---|---|---|---|
| 125144 | 11/1944 | Australia | 416/242 |
| 611650 | 11/1948 | Japan | 416/232 |
| 1-315696 | 12/1989 | Japan | 416/235 |
| 6-147193 | 5/1994 | Japan | 415/119 |
| 6-173895 | 6/1994 | Japan | 415/119 |
| 6-229397 | 8/1994 | Japan | 415/119 |

*Primary Examiner*—Christopher Verdier

[57] ABSTRACT

In an axial fan having a plurality of blades (2, 2, . . . ) around an outer periphery of a hub (1), a cross-sectional configuration of each of the blades (2) at an arbitrary distance from a center of the fan is set such that a blade thickness gradually increases moving away from a blade leading edge (2a) and then gradually decreases towards a blade trailing edge (2b). Also, if a length of a camber line extending from the blade leading edge (2a) to a position where the blade thickness becomes maximum is taken to be L, and a length of a camber line extending from the blade leading edge (2a) to the blade trailing edge (2b) at the arbitrary distance is taken to be $L_O$, then $L/L_O$ falls within a range of 0.27 to 0.35. Thus, the aerodynamic performance never lowers even if the inflow angle of air into the blade (2) varies.

9 Claims, 7 Drawing Sheets

AXIAL FAN

This application is the national phase under 35 U.S.C. §371 of prior PCT International Application No. PCT/JP97/04058 which has an International filing date of Nov. 7, 1997 which designated the United States of America.

TECHNICAL FIELD

The present invention relates to an axial fan to be used for air-conditioner outdoor units and, more particularly, to an axial fan with an improved blade configuration.

BACKGROUND ART

Conventionally, axial fans have been used as an air blower for air-conditioner outdoor units.

FIGS. 11 and 12 are a schematic cross-sectional view and a schematic front view of a common outdoor unit for air conditioners, respectively. As shown in these figures, the air-conditioner outdoor unit contains an axial fan A equipped with a plurality of (e.g., three) blades 2, 2, 2 around an outer circumference of a hub 1. On the suction side of the-axial fan A, a heat exchanger B having an L-shaped cross section is placed, while on the discharge side of the axial fan A there is placed a crosspiece type discharge grille C. Reference character D denotes a compressor, and E denotes a partition plate which separates a heat exchange chamber F in which the axial fan A and the heat exchanger B are placed, from a machine chamber G in which the compressor D is placed.

Meanwhile, in one of conventionally well-known axial fans, blades 2 (denoted by the same reference numeral as that used in FIGS. 11, 12 for convenience) have a generally uniform blade thickness from its leading edge 2*a* to its trailing edge 2*b*, as shown in FIG. 13 (see, for example, Japanese Patent Laid-Open Publication No. 55-112898).

In such an axial fan, the blade configuration is designed such that air flows to the leading edge 2*a* of the blade 2 at an optimum angle (i.e., the angle shown by solid-line arrow).

However, in the case of an air-conditioner outdoor unit with the above-described arrangement, since the outdoor unit is closed on the machine chamber G side, air is taken in from two sides of the heat exchanger B so that the direction of air flowing into the axial fan A tends to vary. Also, since frost is formed on the heat exchanger B that is functioning as an evaporator during the heating operation, the direction of air flowing into the axial fan A varies due to a nonuniform resistance to flow caused by the frost formation.

As a result, the inflow angle of air into the blade 2 also varies so that the flow around the blade 2 does not necessarily become an optimum state. That is, when an axial fan having the blade configuration shown in FIG. 13 is adopted as the axial fan A for the outdoor unit of FIGS. 11 and 12, the air enters the leading edge 2*a* at an angle larger than or smaller than the design angle as shown by broken-line arrows in FIG. 13. Thus, the air flow tends to be separated from the blade surface, resulting in a deteriorated aerodynamic performance and/or an increased aerodynamic sound level of the fan.

DISCLOSURE OF THE INVENTION

The present invention having been accomplished in view of the above problems, an object thereof is to provide an axial fan which suppresses air separation from the blade surface as much as possible even if the inflow angle of air to the blade varies.

In order to achieve the above object, the present invention has a basic construction that, in an axial fan having a plurality of blades around an outer periphery of a hub, a cross-sectional configuration of each of the blades at an arbitrary distance from a center of the fan is set such that a blade thickness gradually increases moving away from a blade leading edge and then gradually decreases towards a blade trailing edge, and that, if a length of a camber line extending from the blade leading edge to a position where the blade thickness becomes maximum is taken to be L, and a length of a camber line extending from the blade leading edge to the blade trailing edge at said arbitrary distance is taken to be $L_0$, then $L/L_0$ falls within a range of 0.27 to 0.35.

With this arrangement, because an aerofoil blade configuration superior in aerodynamic characteristics is obtained, air flow separation from the blade surface is suppressed even if the inflow angle of air has varied, allowing an improvement of aerodynamic performance and a reduction of the aerodynamic sound level in the fan. If $L/L_0<0.27$, then the position at which the blade thickness becomes maximum is too close to the blade leading edge. Thus, air separation will occur earlier. If $L/L_0>0.35$, then the position at which the blade thickness becomes maximum is too close to the blade trailing edge, so that the air inflow path to another blade on the rear side in the direction of rotation would be limited, resulting in an increased aerodynamic sound level.

In the basic constitution of the present invention, if a ratio, $tmax/L_0$, of a maximum tmax of the blade thickness to the camber line length $L_0$ is set to fall within a range of 0.04 to 0.12, the ratio of the maximum blade thickness tmax to the camber line length $L_0$ of the blade becomes optimum for the aerofoil blade configuration. This greatly contributes to the improvement of the aerodynamic performance.

Also, when the ratio, $tmax/L_0$, of the maximum blade thickness tmax to the camber line length $L_0$ is set so as to decrease with increasing ratio, $2R/D_0$, of a double of a distance R from the fan center to a fan outer diameter $D_0$, at least the maximum blade thickness tmax decreases towards an outer circumferential edge of the blade. Therefore, separation of inflow air coming from the outer circumferential edge is effectively prevented from occurring.

When a pressure surface of each blade has a curved surface on an outer circumferential side thereof, the curved surface formed by rounding off the pressure surface from the outer circumferential edge of the blade over a distance S, inflow of air from the blade's outer circumferential edge becomes smoother. Therefore, it is possible to suppress air separation in the vicinity of the blade's outer circumference. In this case, if a length of a curve extending from a blade's root to the blade's outer circumferential edge, connecting maximum-thickness positions of the blade with each other, is taken to be $W_0$, and $S/W_0$ on the curve is set to be within a range of 0.16 to 0.25, then the air separation on the blade's outer circumferential side is prevented more effectively.

The curved surface may be formed extending from a position at a specified distance from the blade leading edge to the blade trailing edge. The reason of this is that on the blade leading edge side, the blade thickness is small due to the aerofoil blade configuration, so that air separation hardly occurs even without forming the curved surface on that side, in which case it is preferable that the curved surface is not formed there.

Also, the curved surface may be formed extending from the blade leading edge to a position at a specified distance from the blade trailing edge. The reason of this is that the blade thickness is small on the blade trailing edge side due to the aerofoil blade configuration, so that not only air separation hardly occurs even without forming the curved surface, but also forming the curved surface on the blade trailing edge side may cause air leakage to occur there, in which case it is preferable that the curved surface is not formed at the relevant location.

Also, the curved surface may be formed extending from a position at a specified distance from the blade leading edge to a position at a specified distance from the blade trailing edge. The reason of this is that the blade thickness is small on both the blade leading edge side and the blade trailing edge side due to the aerofoil blade configuration, so that not only air separation hardly occurs even without forming the curved surface, but also forming the curved surface may cause air leakage to occur on the blade trailing edge side, in which case it is preferable that the curved surface is not formed at the relevant portions.

If, in a trailing edge-side outer circumferential portion of each blade where no curved surface is formed on the pressure surface, the blade's outer circumferential edge forms an arc by having both the pressure surface and a negative-pressure surface rounded off, a smooth inflow of air can be ensured at the portion where the blade thickness is small, and besides air leakage and disturbances of flow due to the air leakage are effectively suppressed.

If each of the blades has a cavity, weight of the blade is reduced in spite of the increase in blade thickness due to the aerofoil blade configuration.

In the case that the cavity is formed between a blade body and a cover plate joined to the blade body, the cavity can be formed easily.

BEST MODE FOR CARRYING OUT THE INVENTION

Figure 11:
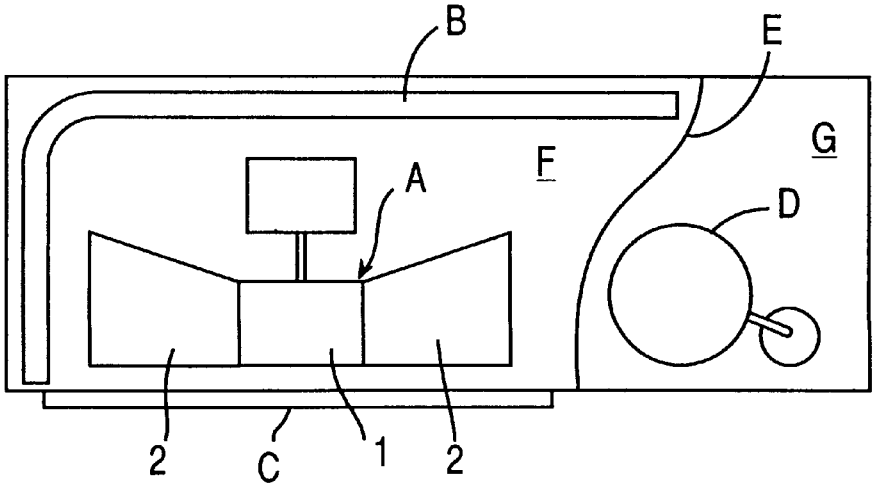
Fig.11 PRIOR ART
FIG. 11 is a cross sectional view of an ordinary air-conditioner outdoor unit.
Figure 12:
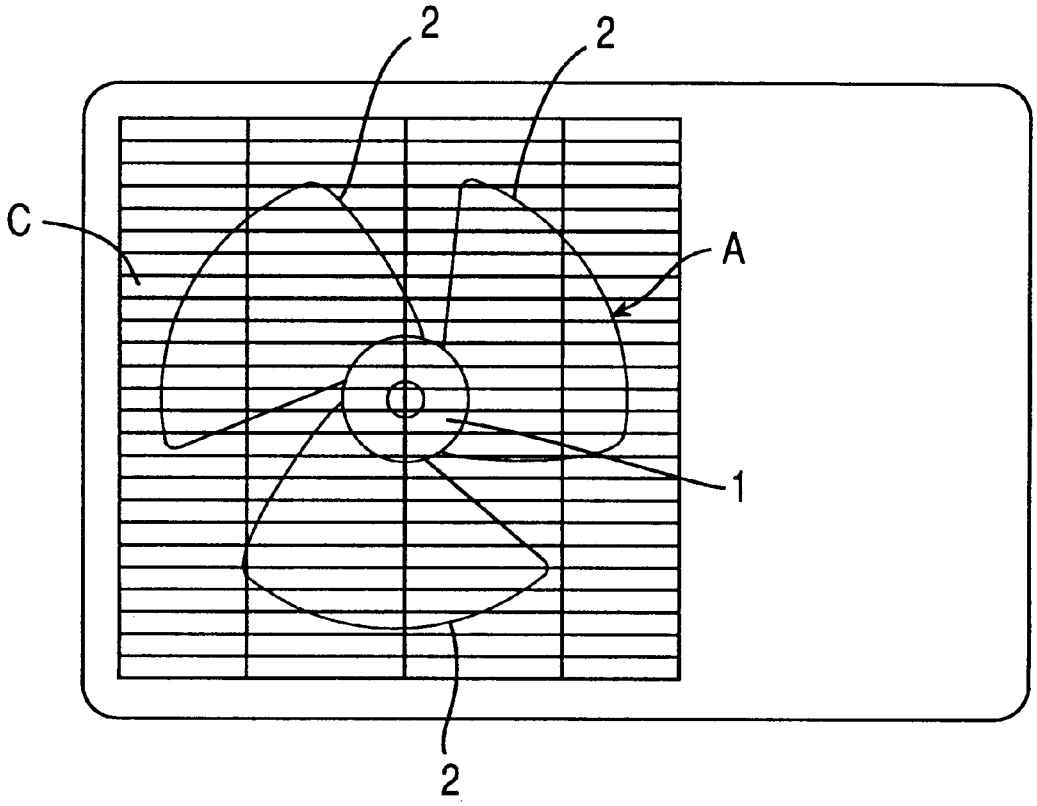
Fig. 12 PRIOR ART
FIG. 12 is a front view of an ordinary air-conditioner outdoor unit.
Figure 13:
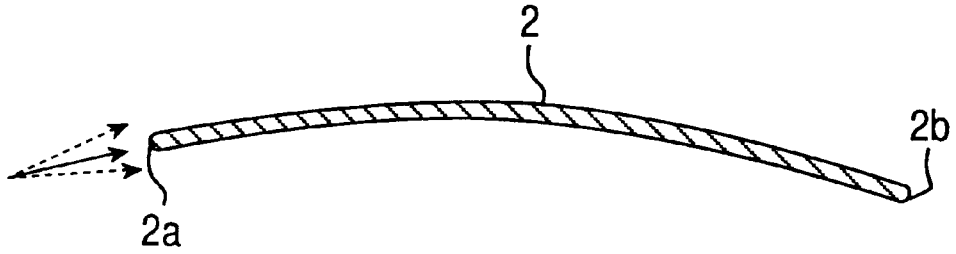
Fig. 13 PRIOR ART
FIG. 13 is a sectional view of a blade of an axial fan according to the prior art.

Several preferred embodiments of the present invention will be described in detail below with reference to the accompanying drawings. It is noted that in FIGS. 1 through 3 and FIGS. 7 through 10, components similar to those shown in FIGS. 11 through 13 are designated by the same reference symbols.

(First Embodiment)

Figure 1:
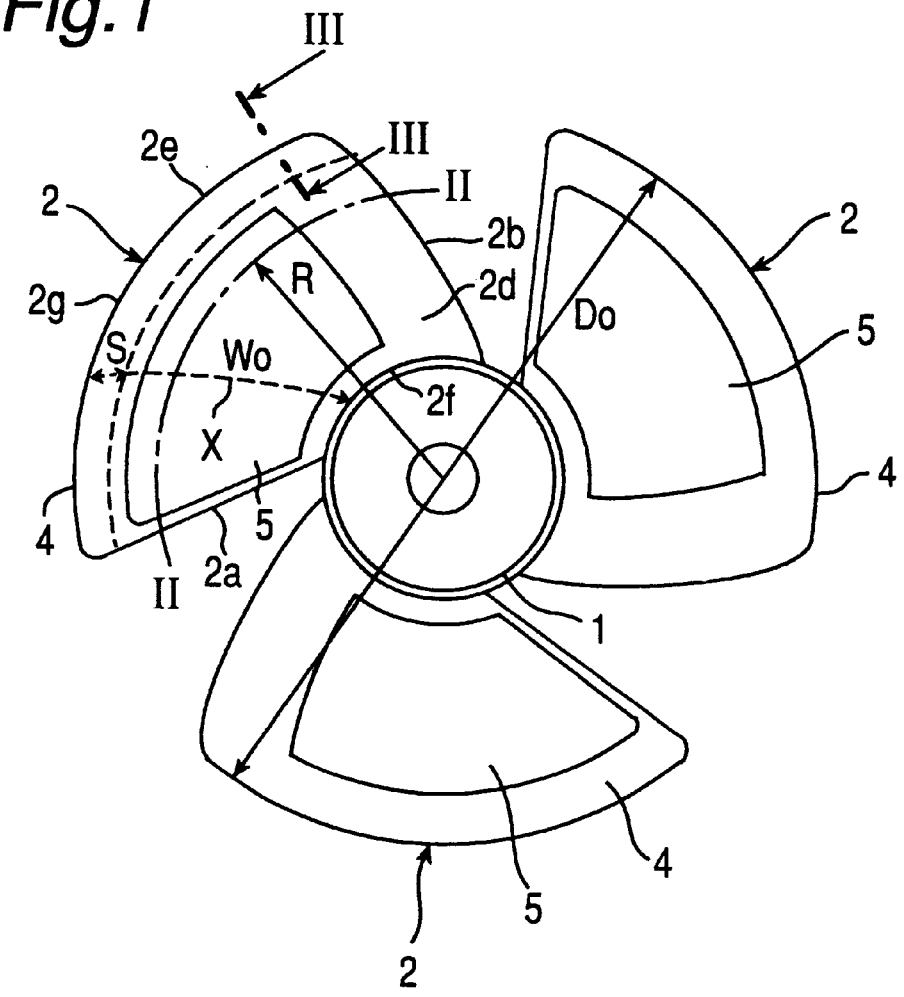
FIG. 1 is a front view of an axial fan according to a first embodiment of the present invention.
Figure 2:
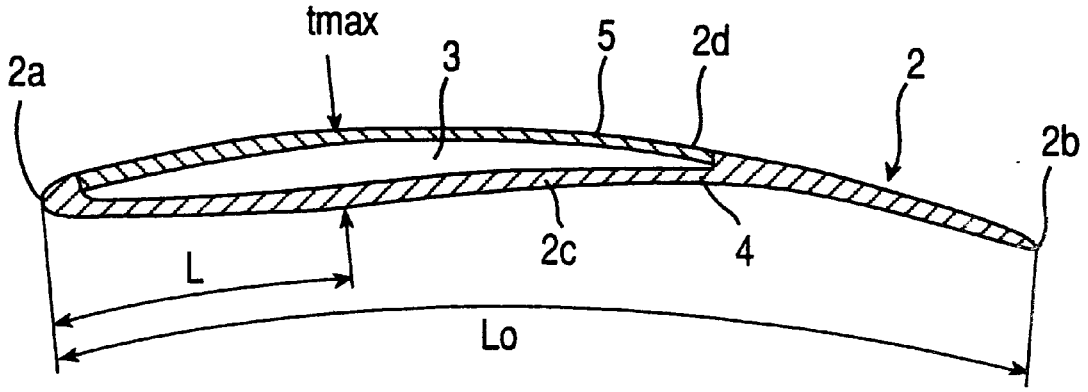
FIG. 2 is an enlarged sectional view taken along the line II—II of FIG. 1.
Figure 3:
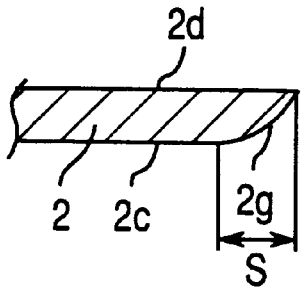
FIG. 3 is an enlarged sectional view taken along the line III—III of FIG. 1.

FIGS. 1 to 3 show an axial fan according to a first embodiment of the present invention.

This axial fan has a plurality of blades 2, 2, . . . provided around an outer periphery of a cylindrical hub 1, like the one described in the background art column.

The cross section of each blade 2 at an arbitrary distance from the fan center has an aerofoil configuration in which the blade thickness gradually increases moving away from the blade leading edge 2*a* and then gradually decreases towards the blade trailing edge 2*b*.

If the length of a camber line from the blade leading edge 2*a* to a position where the blade has a maximum thickness (i.e., the position indicated- by a curve X) is taken to be L, and the length of a camber line extending from the blade leading edge 2*a* to the blade trailing edge 2*b* at the aforementioned arbitrary distance is taken to be $L_0$, then $L/L_0$ is set so as to fall within a range of 0.27 to 0.35. Also, the ratio, $tmax/L_0$, of the maximum blade thickness value tmax to the camber line length $L_0$ is set so as to fall within a range of 0.04 to 0.12. With this arrangement, the ratio of the maximum blade thickness tmax to the camber line length $L_0$ of the blade 2 becomes such that an optimum aerofoil blade configuration is provided, which greatly contributes to improvement of the aerodynamic performance.

Further, each blade 2 has a cavity 3 formed between a blade body 4 and a cover plate 5 joined to the blade body 4, as shown in FIG. 2. This arrangement makes it possible to easily reduce the weight of the blade 2 in spite of the increase in blade thickness due to the aerofoil blade configuration.

Figure 4:
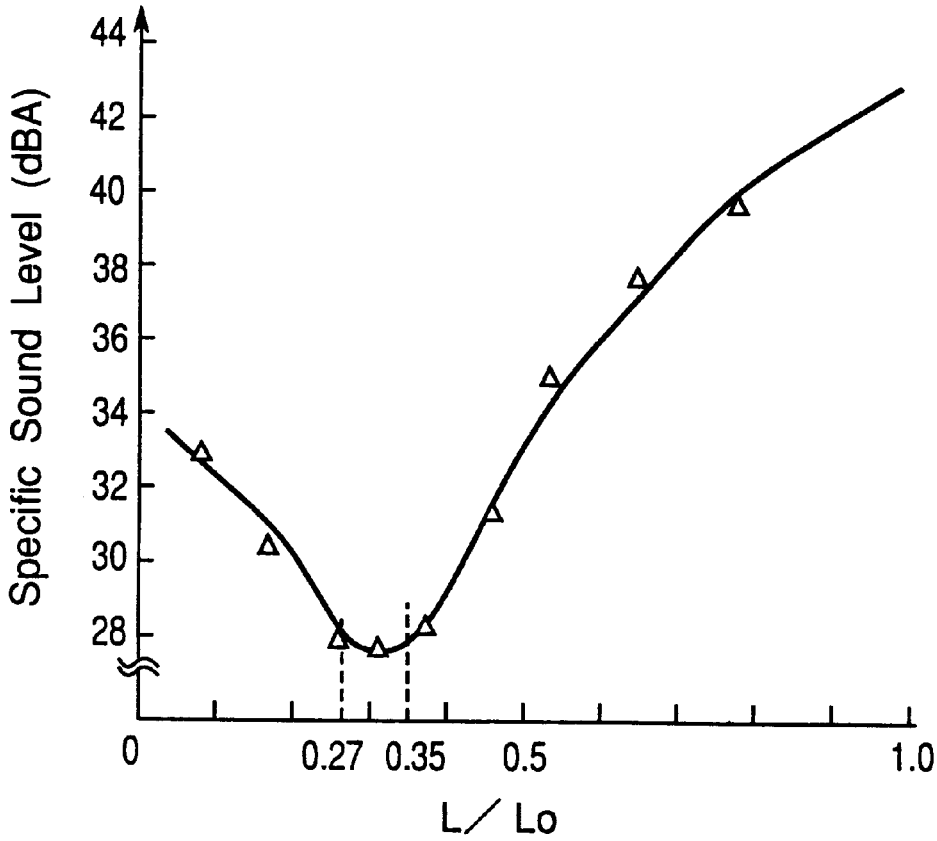
FIG. 4 is a characteristic diagram showing the relationship between $L/L_0$ and the specific sound level in the axial fan according to the first embodiment of the present invention.

With the above constitution, an aerofoil blade configuration superior in aerodynamic characteristics is obtained. Therefore, even if the axial fan is used in, for example, an air-conditioner outdoor unit in which the inflow angle of air to the blades 2 tends to vary, air separation from the blade surface is suppressed, thus allowing an improvement of the aerodynamic performance and a reduction of the aerodynamic sound level in the fan. Furthermore, the ratio of the camber line length Lo of the blade 2 to the maximum blade thickness value tmax becomes optimum for the aerofoil blade configuration, which greatly contributes to the improvement of the aerodynamic performance. If $L/L_0<0.27$, the position at which the blade thickness becomes maximum is too close to the blade leading edge 2*a* so that the separation of inflow air would occur earlier. On the other hand, if $L/L_0>0.35$, the position where the blade thickness becomes maximum is too close to the blade trailing edge 2*b* so that the air inflow path leading to another blade 2 on the rear side in the direction of rotation would be limited, resulting in an increased aerodynamic sound level (see FIG. 4).

Figure 6:
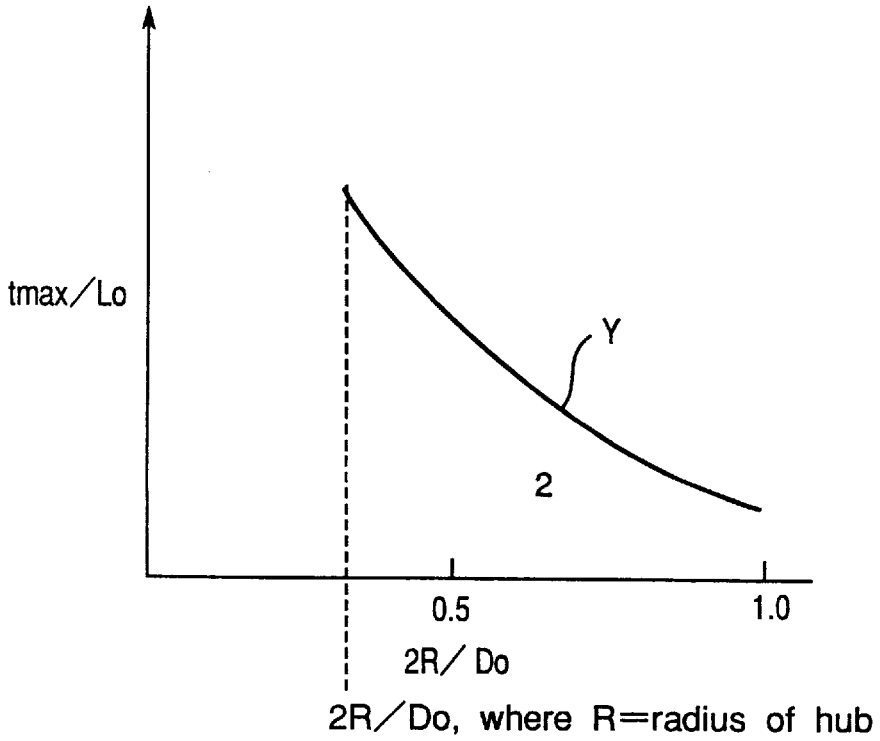
FIG. 6 is a characteristic diagram showing the relationship between $2R/D_0$ and $tmax/L_0$ in the axial fan according to the first embodiment of the present invention.

The ratio, $tmax/L_0$, of the blade thickness maximum value, tmax, to the camber line length, $L_0$, is set so as to decrease with a ratio, $2R/D_0$, of a double of the distance R from the fan center, as the fan outer diameter Do increases, as shown by a curve Y shown in FIG. 6. With this arrangement, at least the maximum blade thickness tmax decreases towards the outer circumference of the blade 2, so that inflow air from an outer circumferential edge 2*e* of the blade 2 is effectively prevented from being separated.

Figure 5:
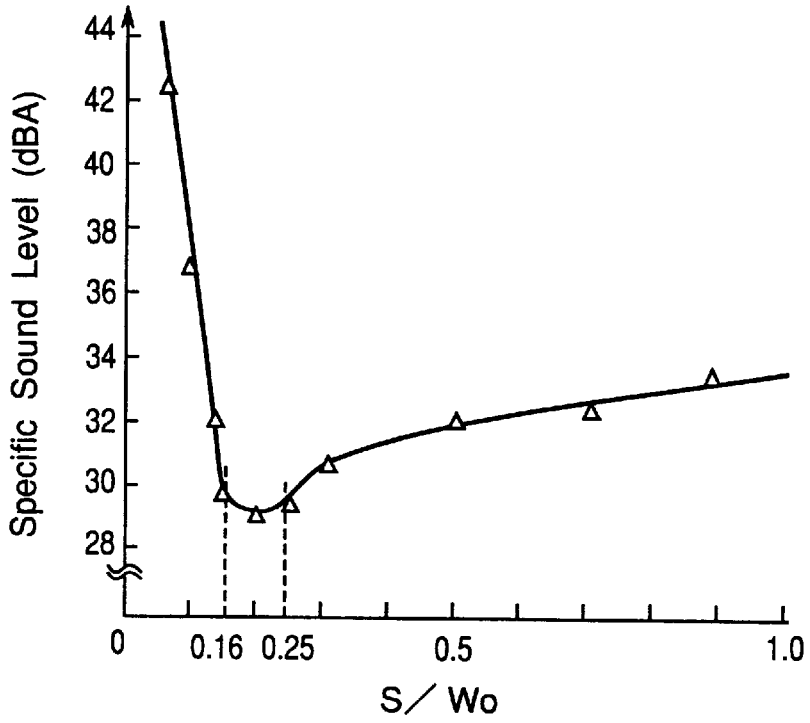
FIG. 5 is a characteristic diagram showing the relationship between $S/W_0$ and the specific sound level in the axial fan according to the first embodiment of the present invention.

On the outer circumferential side of a pressure surface 2*c* of each blade 2, there is a curved surface 2*g* formed by rounding off the pressure surface 2*c* from the blade's outer circumferential edge 2*e* over a distance S inwards, as shown in FIG. 3. If the length of the curve X ranging from the blade's root 2*f* to the blade's outer circumferential edge 2*e* and connecting the maximum thickness positions of the blade 2 is taken to be $W_0$, then, $S/W_0$ on the curve X is set in a range of 0.16 to 0.25. With this arrangement, inflow of air from the blade's outer circumferential edge 2*e* becomes smoother so that the air separation is effectively prevented from occurring in the vicinity of the blades' outer circumferential edges 2*e* (see FIG. 5). If $S/W_0<0.16$, then the effect of the curved surface 2*g* is diluted, and if $S/W_0>0.25$, then it is impossible to ensure obtainment of the aerofoil blade configuration. Therefore, the aerodynamic performance is lowered in both cases.

(Second Embodiment)

Figure 7:
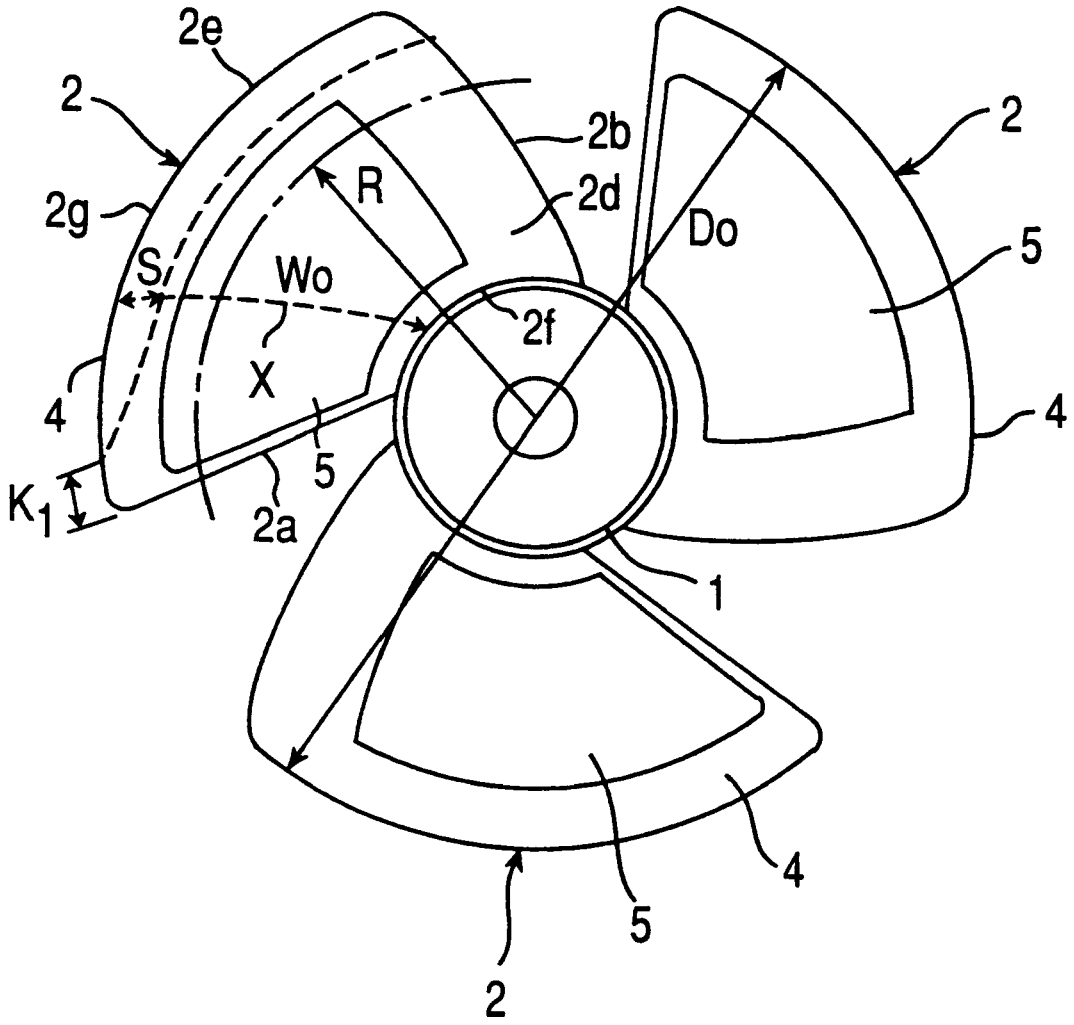
FIG. 7 is a front view of an axial fan according to a second embodiment of the present invention.

FIG. 7 shows an axial fan according to a second embodiment of the present invention.

In this embodiment, the curved surface 2*g* is formed from a position at a specified distance$K_1$from the blade leading edge 2*a* to the blade trailing edge 2*b,* on the outer circumferential portion of the pressure surface 2*c* of each blade 2. Otherwise, the constitution and functional effects are the same as in the first embodiment and so, description about those is omitted here.

The reason for providing the curved surface 2*g* in the above manner is that because the blade thickness on the blade leading edge 2*a* side is thin due to the aerofoil blade configuration of the blade 2, air separation does not occur so much even without forming the curved surface on that side, in which case it is preferable that the curved surface 2*g* is not formed at the portion on the blade leading edge side. The distance $K_1$ is preferably in a range such that the blade thickness at this distance is not so large (up to about 7% of the length of the blade's outer circumferential edge 2*e*).

(Third Embodiment)

Figure 8:
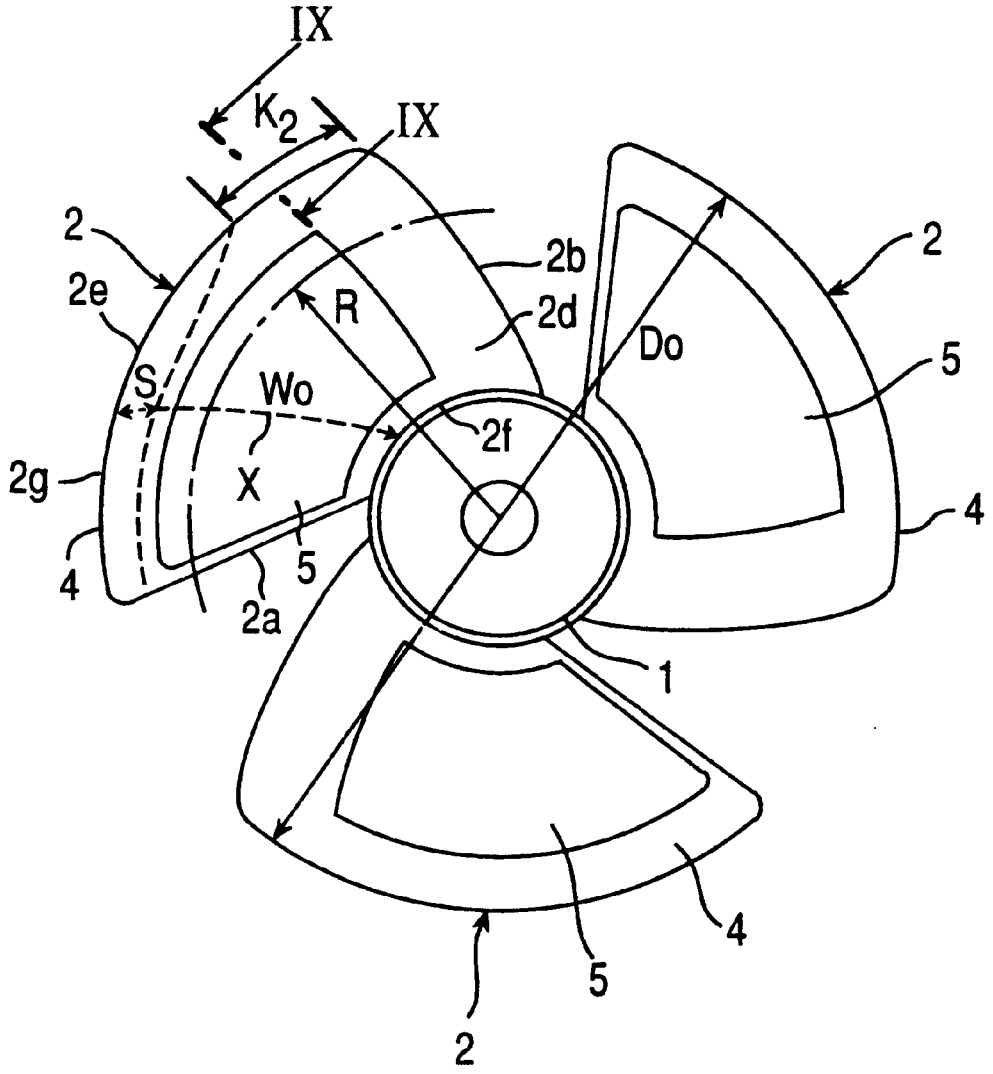
FIG. 8 is a front view of an axial fan according to a third embodiment of the present invention.
Figure 9:
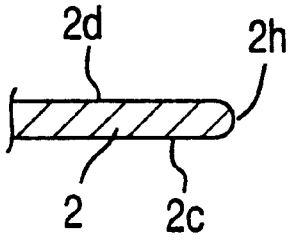
FIG. 9 is an enlarged sectional view taken along the line IX—IX of FIG. 8.

FIGS. 8 and 9 show an axial fan according to a third embodiment of the present invention.

In this embodiment, the curved surface 2*g* is formed from the blade leading edge 2*a* to a position shifted from the blade trailing edge 2*b* toward the leading edge side by a specified distance $K_2$, on the outer circumferential portion of the pressure surface [<m]ditc of the blade 2. In a trailing edge-side outer circumferential portion of each blade 2 where no curved surface 2*g* is formed on the pressure surface 2*c,* the blade's outer circumferential edge 2*e* forms an arc 2*h* by having both the pressure surface 2*c* and a negative-pressure surface 2*d* rounded off, as shown in FIG. 9. Otherwise, the constitution and functional effects are the same as in the first embodiment and so, description about those is omitted here.

The reason for adopting the above configuration is that the blade thickness on the blade trailing edge 2*b* side is thin due to the aerofoil blade configuration. Air separation hardly occurs on the blade trailing edge 2*b* side even without forming the curved surface. Forming the curved surface 2*g* may cause air leakage to occur. Therefore, it is preferable that the curved surface 2*g* is not formed on the blade trailing edge 2*b* side. Moreover, a smooth inflow of air is ensured at the portion where the blade thickness is thin (i.e., an outer circumferential-side portion on the blade trailing edge side), and besides, air leakage and disturbances of flow due to the air leakage are effectively suppressed. The distance $K_2$ is preferably within a range such that the blade thickness at that distance is not so large (up to about 25% of the length of the blade's outer circumferential edge 2*e*).

(Fourth Embodiment)

Figure 10:
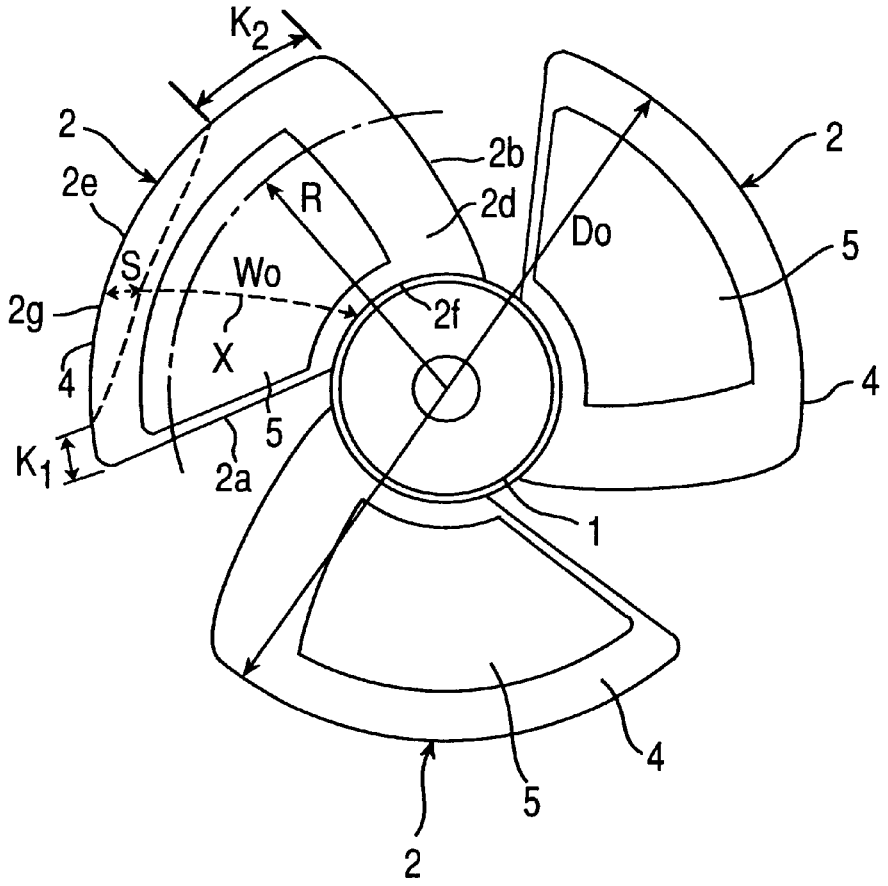
FIG. 10 is a front view of an axial fan according to a fourth embodiment of the present invention.

FIG. 10 shows an axial fan according to a fourth embodiment of the present invention.

In this embodiment, in the outer circumferential portion of the pressure surface 2*c* of the blade 2, the curved surface 2*g* is formed from a position at the specified distance $K_1$ from the blade leading edge 2*a* to a position at the specified distance $K_2$ from the blade trailing edge 2*b*. That is, this embodiment is a combination of the second embodiment and the third embodiment. Otherwise, the constitution and functional effects are the same as in the first through the third embodiments and so, description about the same thing is omitted here.

INDUSTRIAL APPLICABILITY

As described above, the axial fan of the present invention is used in air conditioners or the like.

What is claimed is:

1. An axial fan having a plurality of blades (2, 2, . . . ) around an outer periphery of a hub (1), wherein:

a cross-sectional configuration of each of the blades (2) at an arbitrary distance from the center of the fan is set such that a blade thickness gradually increases moving away from a blade leading edge (2*a*) and then gradually decreases towards a blade trailing edge (2*b*);

each blade has a pressure surface (2*c*) and a negative-pressure surface (2*d*), and the pressure surface (2*c*) comprises a convex surface on the leading-edge side and a concave surface on the trailing edge side, while the negative-pressure surface (2*d*) comprises a convex surface, wherein the pressure surface (2*c*) of each blade (2) has a curved surface (2*g*) on an outer circumferential side thereof, said curved surface formed by rounding off said pressure surface from an outer circumferential edge (2*e*) of the blade over a distance S, wherein if a length of a curve (X) extending from a blade's root (2*f*) to the blade's outer circumferential edge (2*e*), connecting maximum-thickness positions of the blade (2) with each other, is taken to be $W_0$, then $S/W_{,0}$ on the curve (X) falls within a range of 0.16 to 0.25; and if a length of a camber line extending from the blade leading edge (2*a*) to a position where the blade thickness becomes maximum is taken to be L, and the length of the camber line extending from the blade leading edge (2*a*) to the blade trailing edge (2*b*) at said arbitrary distance is taken to be $L_0$, then $L/L_0$ falls within a range of 0.27 to 0.35.

2. The axial fan as set forth in claim 1, wherein a ratio, $tmax/L_0$, of a maximum tmax of the blade thickness to the camber line length $L_0$ falls within a range of 0.04 to 0.12.

3. The axial fan as set forth in claim 2, wherein said ratio, $tmax/L_0$, of the maximum blade thickness tmax to the camber line length $L_0$ is set so as to decrease as a ratio, $2R/D_0$, of a double of a distance R from the fan center to a fan outer diameter $D_0$ increases.

4. The axial fan as set forth in claim 1, wherein said curved surface (2*g*) is formed extending from a position at a specified distance from the blade leading edge (2*a*) to the blade trailing edge (2*b*).

5. The axial fan as set forth in claim 1, wherein said curved surface (2*g*) is formed extending from the blade leading edge (2*a*) to a position at a specified distance from the blade trailing edge (2*b*).

6. The axial fan as set forth in claim 1, wherein said curved surface (2*g*) is formed extending from a position at a specified distance from the blade leading edge (2*a*) to a position at a specified distance from the blade trailing edge (2*b*).

7. The axial fan as set forth in claim 1, wherein in a trailing edge-side outer circumferential portion of each blade (2) where no curved surface (2*g*) is formed on the pressure surface (2*c*), said blade's outer circumferential edge (2*e*) forms an arc (2*h*) by having both the pressure surface (2*c*) and the negative-pressure surface (2*d*) rounded off.

8. The axial fan as set forth in claim 1, wherein each blade (2) has a cavity (3).

9. The axial fan as set forth in claim 8, wherein said cavity (3) is formed between a blade body (4) and a cover plate (5) joined to the blade body (4).

* * * * *